US006110256A

United States Patent [19]

Reynolds et al.

[11] Patent Number: 6,110,256

[45] Date of Patent: Aug. 29, 2000

[54] APPARATUS AND METHOD FOR REMOVING PARTICULATES AND CORROSIVE GASES FROM A GAS STREAM

[75] Inventors: Philip E. Reynolds, Westfield, N.J.; Isaac Ray, Brooklyn, N.Y.

[73] Assignee: Croll Reynolds Clean Air Technologies, Inc., Westfield, N.J.

[21] Appl. No.: 09/099,028

[22] Filed: Jun. 17, 1998

[51] Int. Cl.[7] ..... B03C 3/014

[52] U.S. Cl. ..... 95/4; 95/65; 95/66; 95/69; 95/71; 95/75; 96/19; 96/44; 96/53; 96/57; 96/74

[58] Field of Search ..... 95/4, 69, 71, 64–66, 95/75; 96/18, 52, 53, 57, 74, 97, 19, 44, 45, 47, 50

[56] References Cited

U.S. PATENT DOCUMENTS

| | | | |
|---|---|---|---|
| 1,250,088 | 12/1917 | Burns | 95/75 X |
| 1,284,166 | 11/1918 | Welch | 96/44 X |
| 2,024,226 | 12/1935 | Irwin et al. | 96/53 |
| 2,273,194 | 2/1942 | Hedberg et al. | 96/53 X |
| 3,299,620 | 1/1967 | Hollingworth | 96/53 |
| 3,494,099 | 2/1970 | Eng et al. | 96/18 X |
| 4,145,191 | 3/1979 | Kunchal et al. | 95/65 |
| 4,229,411 | 10/1980 | Kisters et al. | 96/53 X |
| 4,256,468 | 3/1981 | Mazer et al. | 95/65 |
| 4,305,909 | 12/1981 | Willett et al. | 96/53 X |
| 4,473,380 | 9/1984 | Voliva et al. | 96/53 X |
| 4,957,512 | 9/1990 | Denisov et al. | 95/66 |
| 5,039,318 | 8/1991 | Johansson | 96/74 |
| 5,084,072 | 1/1992 | Reynolds | 95/65 |
| 5,154,734 | 10/1992 | Yung | 95/65 X |
| 5,254,155 | 10/1993 | Mensi | 96/53 X |
| 5,391,220 | 2/1995 | Patterson | 95/69 |

OTHER PUBLICATIONS

Starke et al, "The Wet Wall Electrostatic Precipitator.", Undated.

"The Quest for a Better Submicron Particle Trap," *Environment Technology, Journal of Advanced Science and Engineering*, vol. 7, No. 3, May/Jun. 1997.

*Primary Examiner*—Richard L. Chiesa
*Attorney, Agent, or Firm*—Arthur Jacob

[57] ABSTRACT

Apparatus and method for removing particulates and corrosive gases from a gas stream includes the serial use of a condensing wet electrostatic precipitator section for removing smaller particulates, in the submicron range, in conjunction with a vertically aligned preliminary scrubber section which removes larger particulates, in the micron range, and corrosive gases, in an integrated unit in which the temperature and moisture conditions in the gas stream are controlled for assuring effective and efficient operation of the condensing wet electrostatic precipitator section. Discharge electrodes of the electrostatic precipitator are supported by insulators which are protected against deleterious deposits of particulates by discharge electrode elements and collector electrode elements placed between the gas stream and the insulators.

22 Claims, 4 Drawing Sheets

APPARATUS AND METHOD FOR REMOVING PARTICULATES AND CORROSIVE GASES FROM A GAS STREAM

The present invention relates generally to the reduction of contaminants emitted into the atmosphere as a result of commercial and industrial processes and pertains, more specifically, to apparatus and method for the removal of particulates and corrosive gases from industrial exhausts.

The continuing pursuit of more stringent regulations pertaining to the control of contaminants emitted into the ambient atmosphere has led to the requirement for more effective treatment of emissions emanating from commercial and industrial processes. In particular, the removal of toxic substances from industrial exhausts has received increased attention. Recent studies have suggested that the presence of submicron particles cause much of the illnesses associated with air pollution. Accordingly, greater emphasis has been placed upon the removal of such fine particulates from industrial exhausts.

High temperature incineration, heating processes, metal smelting and other industrial processes emit vapors containing volatile metals or metal compounds, such as arsenic, cadmium, nickel, cobalt and lead, and compounds of such metals. Upon leaving a combustor, flue gases containing these constituents usually are cooled to remove thermal energy. In the process of cooling, the toxic metals are condensed to form extremely fine, submicron particles, that is, particles smaller than one micron in diameter. The toxic compounds from combustion also are condensed upon the surface of ash or other particles present in the exhaust gas.

For a given total mass of particles in a gas stream, the surface area of smaller particles is much greater than the surface area of larger particles. Thus, one gram of particles measuring 0.1 micron in diameter has ten times as much total surface area as is present in one gram of particles measuring 1.0 micron in diameter. Since toxic vapors condense essentially uniformly on the surface area of all particles, capturing one gram of 0.1 micron particles is ten times more effective in removing toxic substances than capturing one gram of 1.0 micron particles emanating from a combustor. Further, the fact that submicron particles penetrate more readily into the lungs and into the bloodstream of humans and animals renders the capture and safe disposal of such submicron particles even more important.

One of the more recent advancements in the removal of fine particulates from a gas stream is the utilization of condensing wet electrostatic precipitators wherein the particulates carried by an incoming gas stream are entrained in condensate formed on walls of the precipitator and are flushed from the walls for collection. The present invention provides improvements in the construction and operation of apparatus utilizing condensing wet electrostatic precipitators. As such, the present invention attains several objects and advantages, some of which are summarized as follows: Increases the efficiency and effectiveness of a condensing wet electrostatic precipitator for the removal of smaller particulates by providing controlled conditions for the formation of particle-capturing and flushing condensate; removes corrosive gases, as well as particulates, in a continuous process carried out in an integrated apparatus; enables more economical construction and operation of a condensing wet electrostatic precipitator by the removal of corrosive gases from a gas stream prior to entry of the gas stream into the condensing wet electrostatic precipitator, enabling the use of less expensive materials in the construction of the precipitator; provides a process and an integrated apparatus for the removal of larger particulates from an incoming gas stream so as to pass a gas stream containing essentially only smaller particulates to a condensing wet electrostatic precipitator, for increased effectiveness and efficiency; utilizes a heat exchange arrangement which increases the effectiveness and efficiency of heat transfer in cooling the condensing walls of a condensing wet electrostatic precipitator; reduces installation space requirements and cost; maintains cleaner electrodes during operation of a condensing wet electrostatic precipitator for maximizing effectiveness and efficiency; protects against deleterious deposits of particulates upon insulators which support the discharge electrodes of the electrostatic precipitator; provides an integrated apparatus and process for effective and reliable operation over a relatively long service life.

The above objects and advantages, as well as further objects and advantages, are attained by the present invention which may be described briefly as apparatus for removing particulates and corrosive gases from an incoming gas stream so as to deliver an outgoing gas stream free of the removed particulates and corrosive gases, the apparatus comprising: an inlet for receiving the incoming gas stream and directing the incoming gas stream to a path of travel through the apparatus; an outlet located along the path of travel extending vertically upwardly between the inlet and the outlet for delivering the outgoing gas stream; a wet electrostatic precipitator section along the path of travel between the inlet and the outlet; a scrubber section located vertically below the wet electrostatic precipitator along the path of travel between the inlet and the wet electrostatic precipitator section, the scrubber section being aligned vertically with the wet electrostatic precipitator section and including a moisture supplier for supplying moisture to the incoming gas stream; and a neutralizer for delivering a neutralizing agent into the path of travel between the scrubber section and the wet electrostatic precipitator section for contacting the incoming gas stream and neutralizing corrosive gases in the incoming gas stream; whereby the incoming gas stream is moisturized with the moisture, and corrosive gases within the incoming gas stream are neutralized prior to entry of the incoming gas stream into the wet electrostatic precipitator section.

Further, the invention pertains to a method for removing particulates and corrosive gases from an incoming gas stream so as to deliver an outgoing gas stream free of the removed particulates and corrosive gases, the method comprising: receiving the incoming gas stream and directing the incoming gas stream along a path of travel toward a wet electrostatic precipitator section; scrubbing the incoming gas stream along the path of travel to remove larger particulates prior to passing the incoming gas stream to the wet electrostatic precipitator section; supplying moisture to the incoming gas stream prior to passing the incoming gas stream to the wet electrostatic precipitator section; neutralizing corrosive gases in the incoming gas stream prior to passing the incoming gas stream to the wet electrostatic precipitator section; whereby the incoming gas stream is moisturized with the moisture, and corrosive gases within the incoming gas stream are neutralized prior to entry of the incoming gas stream into the wet electrostatic precipitator section; removing smaller particulates from the incoming gas stream by condensing moisture supplied to the incoming gas stream within the wet electrostatic precipitator section; and delivering the outgoing gas stream at an outlet subsequent to passing the incoming gas stream to the wet electrostatic precipitator section.

Additionally, the invention relates to an improvement in an apparatus for removing particulates from an incoming gas stream so as to deliver an outgoing gas stream free of the removed particulates, the improvement comprising: an inlet for receiving the incoming gas stream and directing the incoming gas stream to a path of travel through the apparatus; an outlet located along the path of travel for delivering the outgoing gas stream; a wet electrostatic precipitator section along the path of travel between the inlet and the outlet; and a moisture supplier for supplying moisture to the incoming gas stream, the moisture supplier including a liquid distributor for distributing liquid into the incoming gas stream; the wet electrostatic precipitator section including collection electrodes having condensing walls upon which moisture supplied to the incoming gas stream is condensed such that condensate formed on the condensing walls entrains particulates; the moisture supplier further including a temperature controller for controlling the temperature of the liquid distributed by the liquid distributor so as to assure the formation of condensate on the condensing walls of the collection electrodes.

Further, the invention includes an improvement in a method for removing particulates from an incoming gas stream so as to deliver an outgoing gas stream free of the removed particulates, the improvement comprising: receiving the incoming gas stream and directing the incoming gas stream along a path of travel toward a wet electrostatic precipitator section; supplying moisture to the incoming gas stream prior to passing the incoming gas stream to the wet electrostatic precipitator section, whereby the incoming gas stream is moisturized with the moisture prior to entry of the incoming gas stream into the wet electrostatic precipitator section; removing particulates from the incoming gas stream by condensing moisture supplied to the incoming gas stream within the wet electrostatic precipitator section; controlling the temperature of the moisture supplied to the incoming gas stream so as to assure condensation of the moisture in the electrostatic precipitator section and consequent entrainment of the particulates; and delivering the outgoing gas stream at an outlet subsequent to passing the incoming gas stream to the wet electrostatic precipitator section.

Additionally, the invention provides an improvement in an electrostatic precipitator in which a plurality of discharge electrodes are supported within a gas stream by a support assembly including insulator members adjacent the gas stream, the improvement comprising: discharge electrode elements in the support assembly, located between the gas stream and the insulator members; and collector electrode elements juxtaposed with the discharge electrode elements so as to establish an electrostatic field between each discharge electrode element and a corresponding collector electrode element for collecting particulates in the gas stream on each collector electrode element to preclude deposit of the collected particulates on the insulator members.

The invention will be understood more fully, while still further objects and advantages will become apparent, in the following detailed description of preferred embodiments of the invention illustrated in the accompanying drawing, in which.

Figures 1, 1A, 1B:
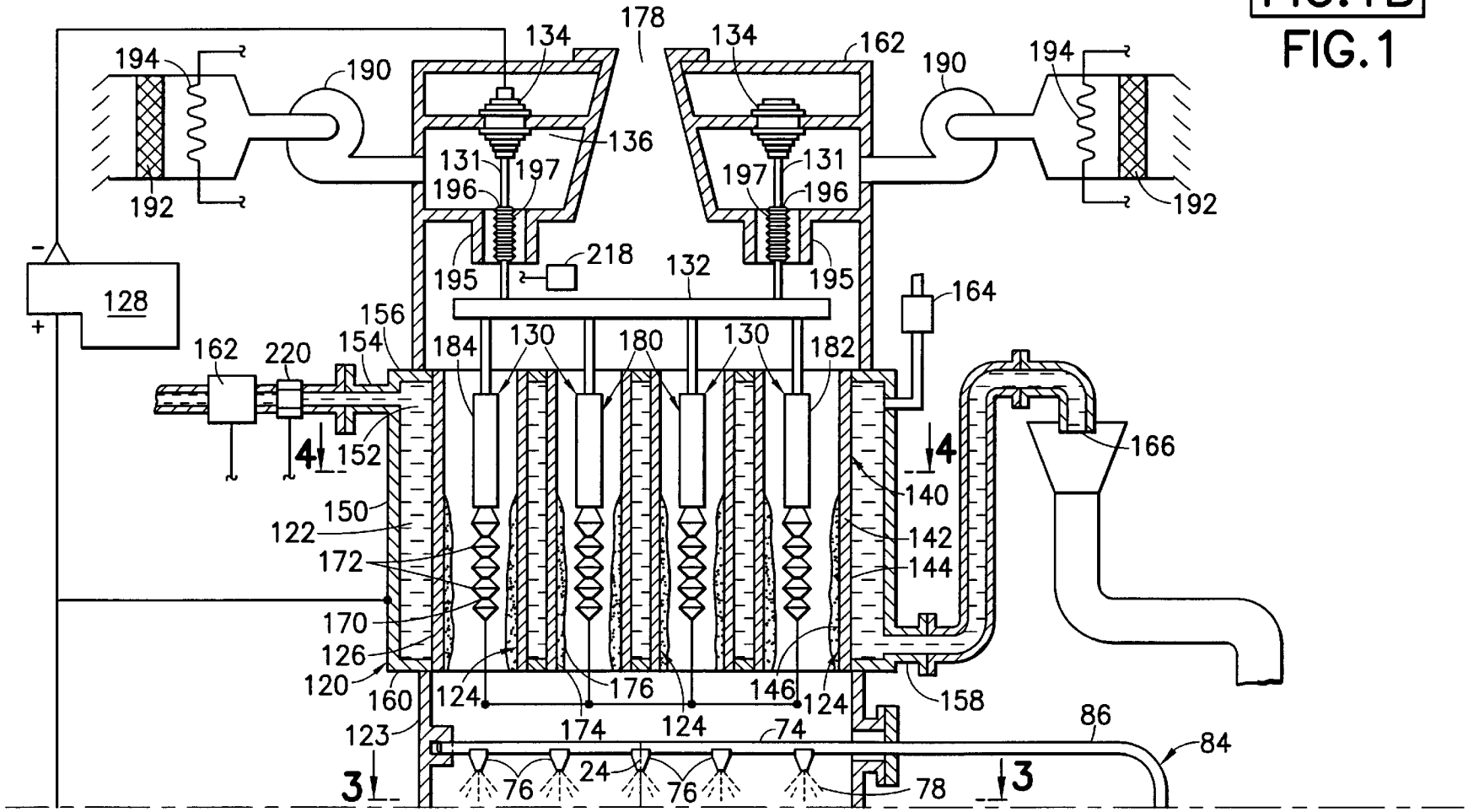
FIG. 1 is a partially diagrammatic, longitudinal cross-sectional view of an apparatus constructed in accordance with the present invention.
Figure 1B:
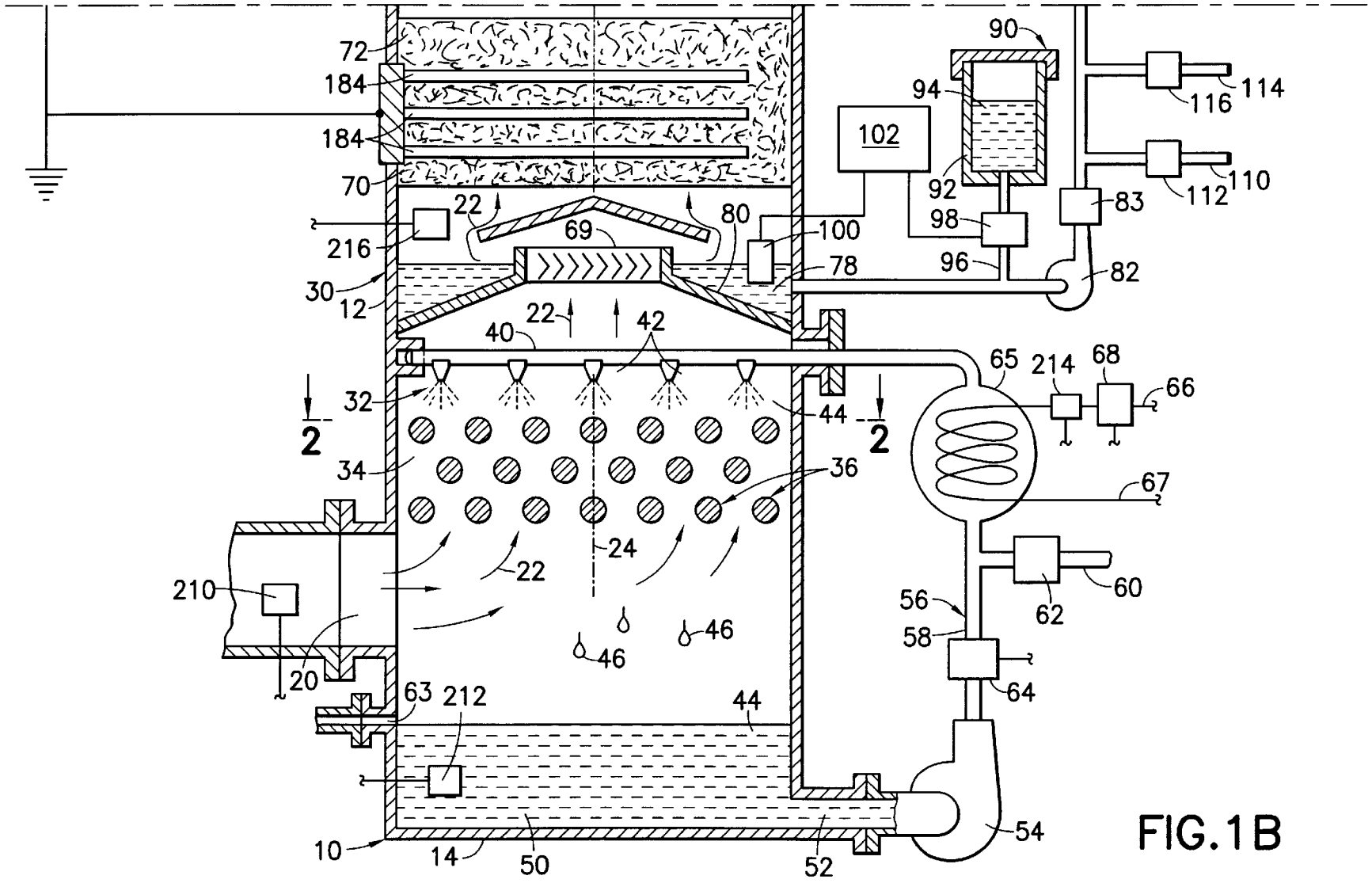
Figure 2:
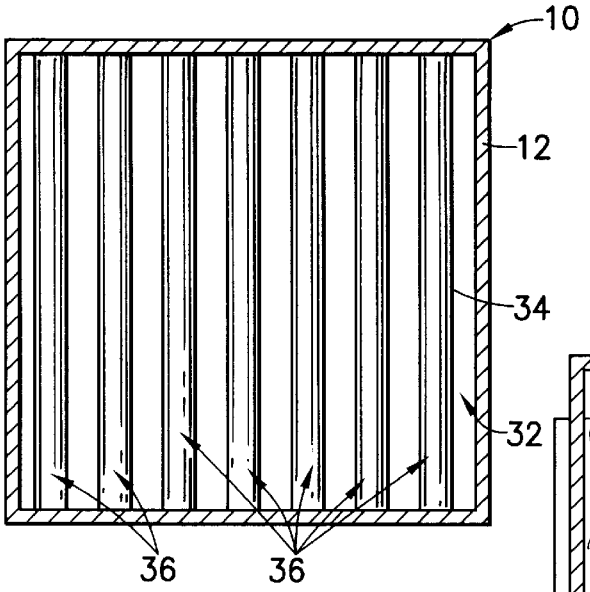
FIG. 2 is a transverse cross-sectional view taken along line 2—2 of FIG. 1.

Referring now to the drawing, and especially to FIG. 1 thereof, an apparatus constructed in accordance with the present invention is illustrated generally at 10 and is seen to include a housing 12 which extends vertically from a lower bottom end 14 to an upper top end 16. An inlet is shown in the form of a port 20 located adjacent the bottom end 14 and receives an incoming gas stream, as indicated by arrows 22, laden with contaminants, including particulates and corrosive gases. The incoming gas stream 22 is directed upwardly along a vertical path of travel 24 into a scrubber section 30, passing first into a first stage scrubber in the form of a liquid distribution scrubber 32 having a scrubbing matrix 34 comprised of a plurality of transverse bars 36, as seen in FIG. 2.

A moisture supplier in the scrubber section 30 includes a liquid distributor in the form of a spray header 40 having a plurality of spray nozzles 42 located immediately above the matrix 34 for spraying water 44 downwardly into the gas stream 22 as the gas stream 22 travels upwardly along the path of travel 24 through the matrix 34. The turbulence induced by the bars 36 of the matrix 34 accomplishes thorough mixing of the incoming gas stream 22 with the water 44 and larger particulates, in sizes of about two microns and above in diameter, are entrained within water droplets 46 which drop downwardly, by gravity, into a reservoir 50 at the bottom of the housing 12. In addition to the removal of these larger particulates, gas absorption takes place to remove some toxic gases from the gas stream 22. Water 44 is drawn from the reservoir 50, through a passage 52, by a pump 54 which circulates the water to the spray header 40 through a water circuit 56 including a water conduit 58. A bleed line 60 communicates with the water conduit 58 through a bleed control valve 62 for periodically directing portions of water 44 out of the water circuit 56 for removal of the solids collected in the water 44. An overflow drain 63 maintains the water 44 in reservoir 50 at a predetermined level. A control valve 64 controls the flow of water in the water circuit 56, and a heat exchanger 65, which includes an input 66 for a heat exchange medium and an output 67, and a control valve 68 for controlling circulation of the heat exchange medium through the heat exchanger 65, is placed in the water circuit 56 for purposes to be described fully hereinafter.

Figure 3:
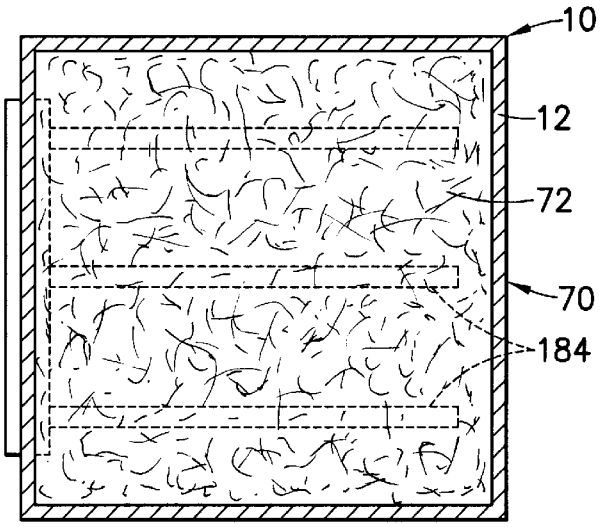
FIG. 3 is a transverse cross-sectional view taken along line 3—3 of FIG. 1.

Upon leaving the first stage scrubber, the gas stream 22 continues moving upwardly in scrubber section 30, passing through a mist eliminator 69 and entering a second stage scrubber in the form of a packed bed scrubber 70 which includes a bed 72 of packing, as seen in FIG. 3. A further moisture supplier includes a liquid distributor in the form of a spray header 74 having a plurality of spray nozzles 76 located immediately above the packed bed 72 for spraying additional water 78 downwardly into the gas stream 22 as the gas stream 22 travels upwardly along the path of travel 24 through the bed 72. The additional water 78 is held in an interstage pan 80 and is circulated by a pump 82 to the spray header 74, as controlled by a control valve 83, through a water circuit 84 which includes a water conduit 86.

A neutralizer 90 includes a reservoir 92 containing a neutralizing agent 94. The reservoir 92 communicates with the water circuit 84 through a neutralizer line 96 and a control valve 98. Neutralizing agent 94 is fed from the reservoir 92 through the neutralizer line 96 into the water 78 in the water conduit 86 and the mixture of water 78 and neutralizing agent 94 passes through the spray header 74 and spray nozzles 76 to be delivered into the bed 72 and into the gas stream 22 passing through the bed 72 along the path of travel 24. Corrosive gases in the gas stream 22 are neutralized as the gas stream 22 is contacted by the neutralizing mixture in the bed 72. Intimate contact and effective neutralization is attained by the passage of the gas stream 22 through the bed 72. Typically, corrosive gases such as hydrogen chloride, sulfur dioxide and the like are neutralized with sodium hydroxide or other commonly available neutralizing agents. A sensor 100 senses the pH value of the solution in the interstage pan 80 and signals a controller 102 which actuates control valve 98 for supplying neutralizing agent 94, as required. A bleed line 110 communicates with the water conduit 86 through a bleed control valve 112 for periodically directing portions of water 78 out of the water circuit 84 for treatment, and a make-up water line 114 delivers make-up water to the water circuit 84, through a make-up control valve 116, as required.

Figure 4:
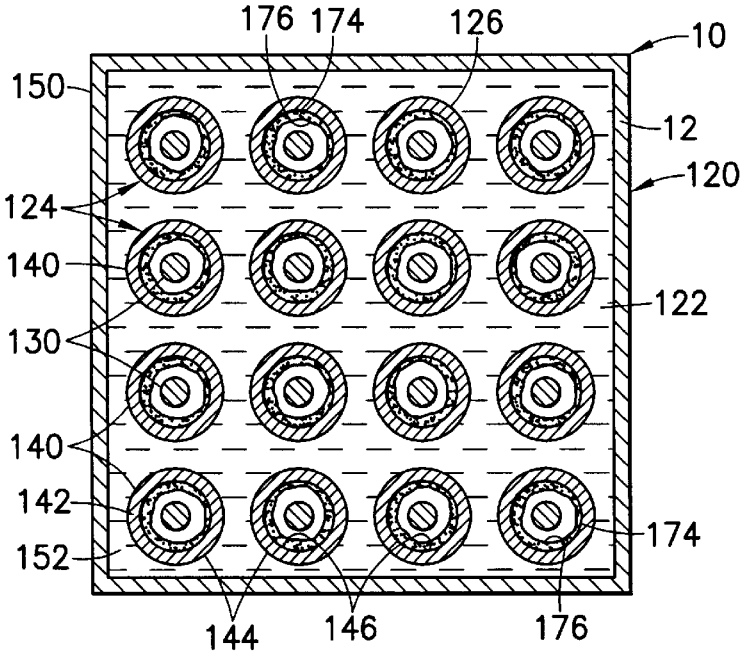
FIG. 4 is a transverse cross-sectional view taken along line 4—4 of FIG. 1.

The gas stream 22, now essentially devoid of larger particulates and corrosive gases, continues upwardly along path of travel 24 out of the scrubber section 30 and into a wet electrostatic precipitator section 120 wherein the gas stream 22 passes through a condensing wet electrostatic precipitator 122. Precipitator 122 includes an inlet area 123 extending transversely across the wet electrostatic precipitator section 120, and a plurality of electrode assemblies 124 arranged in a matrix 126, as seen in FIG. 4, the matrix 126 extending across the inlet area 123 and the electrode assemblies 124 being powered by a source 128 of high voltage, in a now conventional manner. To that end, the source 128 is connected to discharge electrodes 130 of the electrode assemblies 124 through a support assembly which includes support members 131 and a support frame in the form of a bus frame 132 supported by insulator members in the form of insulators 134 placed in corresponding chambers 136, for purposes to be described below. The bus frame 132 is suspended below the insulators 134 by the support members 131, and the discharge electrodes 130 are suspended downwardly from the bus frame 132 such that each discharge electrode 130 passes through the center of a corresponding collection electrode 140 having a tubular wall 142 connected to the source 128 so that the discharge electrodes 130 carry an electrostatic charge of given polarity and the collection electrodes 140 carry an electrostatic charge having a polarity opposite to the given polarity. In the illustrated embodiment, the discharge electrodes 130 carry a negative charge, while the collection electrodes 140 carry a positive charge.

A coolant jacket in the form of water jacket 150 surrounds the electrode assemblies 124 and, more specifically, the tubular walls 142 of the collection electrodes 140 surrounding the discharge electrodes 130 in the matrix 126 so as to enable circulation of a coolant, shown in the form of water 152, around the outside of the tubular walls 142, in contact with the outside surfaces 144 of the tubular walls 142, to maintain the temperature of the tubular walls 142 at a level most conducive to condensation of the moisture carried by the gas stream 22 on the inside surfaces 146 of the tubular walls 142 as the gas stream 22 passes through the interior of the tubular walls 142. Cooling water 152 is introduced into the water jacket 150 at a water inlet 154 located adjacent the top end 156 of the water jacket 150 and is circulated to a water outlet 158 adjacent the bottom end 160 of the water jacket 150. A control valve 162 controls the flow of water 152 into water jacket 150. An air bleed 164 assures that the water jacket 150 is filled with water 152. By placing the water inlet 154 vertically above the water outlet 158 circulation of the water 152 through the water jacket 150 is assisted by the tendency of the cooler water to move downwardly in the water jacket 150. The warmer water is delivered at the water outlet 158 and flows to an exit 166 for passage to a cooling tower (not shown).

The discharge electrodes 130 each include an ionizing section 170 having relatively sharp points 172. As known in electrostatic precipitators, a strong electrostatic field is generated in each electrode assembly 124, between the discharge electrode 130 and the collection electrode 140, and the sharp points 172 cause corona discharge. As the gas stream 22 passes between the discharge electrode 130 and the collection electrode 140 of each electrode assembly 124, particulates carried in the gas stream 22 are intercepted by negatively charged gas molecules moving toward the tubular wall 142 and the particulates become fully saturated with charge. The strong electrostatic field causes the charged particulates, illustrated at 174, together with entrained moisture from the fully saturated gas stream 22, to migrate to the inside surface 146 of the tubular wall 142. The cooled inside surface 146 enables condensation of the moisture from the saturated gas stream 22, establishing a film of condensate 176 on the inside surface 146. The condensate 176 runs down the tubular wall 142 and flushes away the particulates 174 attracted to the inside surface 146, thus creating a self-cleaning mechanism which is a hallmark of a condensing wet electrostatic precipitator. In this manner, submicron particulates are removed from the gas stream 22, and the cleaned gas stream 22 proceeds upwardly along path of travel 24 to be discharged through an outlet 178 at the top end 16 of the housing 12 as an outgoing gas stream.

In order to sustain the effectiveness of the electrode assemblies 124 and maintain efficiency during operation of the condensing wet electrostatic precipitator 122, the discharge electrodes 130 each are provided with an attraction section 180, in addition to the ionizing section 170, the attraction sections 180 including attraction surfaces 182. Further electrodes 184 extend laterally into the bed 72 of the packed bed scrubber 70 so as to be embedded in the bed 72. The further electrodes 184 are connected to the source 128 of high voltage and are charged by the source 128 with a charge opposite to the charge on the discharge electrodes 130, in this instance the charge being a positive charge. As the moisture laden gas stream 22 passes through the bed 72, some of the moisture in the form of small droplets carried in the gas stream 22 becomes charged with a positive charge. Upon passing into the electrode assemblies 124, the positively charged moisture is attracted to the attraction surfaces 182 where the moisture accumulates and eventually runs down along the discharge electrodes 130, cleansing the discharge electrodes 130 of any residual particulates and maintaining the discharge electrodes 130 clean and efficient.

In order to maintain the surfaces of insulators 134 free of moisture or any other deposits which could reduce the dielectric function of the insulators 134, the insulators 134 are isolated from the outgoing gas stream 22 by placement in the respective chambers 136. Purging air is delivered to the chambers 136 by fans 190 which draw ambient air through filters 192 and heat exchangers 194 to deliver air having a controlled temperature. The purging air is exhausted from each chamber 136 through a tubular element 195 to join the outgoing gas stream 22. The positive pressure maintained within the chambers 136, together with the controlled temperature of the purging air, maintains the surfaces of the insulators 134 essentially free of deposits which could otherwise cause a breakdown of the function of the insulators 134.

In addition, further discharge electrodes in the form of discharge electrode elements 196 carrying sharply pointed further ionizing sections 197 extend through and are juxtaposed with the tubular elements 195 so as to establish an electrostatic field between corresponding tubular elements 195 and electrode elements 196. The discharge electrode elements 196 are located vertically above the bus frame 132 and vertically below the insulators 134 so as to be placed between the gas stream 22 and the insulators 134. Particulates which otherwise might tend to enter chamber 136 through the tubular elements 195 are charged by the ionizing sections 197 and are precluded from entering chamber 136 by migrating to and being collected on the tubular elements 195, which serve as collector electrode elements. In this manner, even in the absence of sufficient purging air, the insulators 134 are protected against deleterious deposits.

Figure 5:
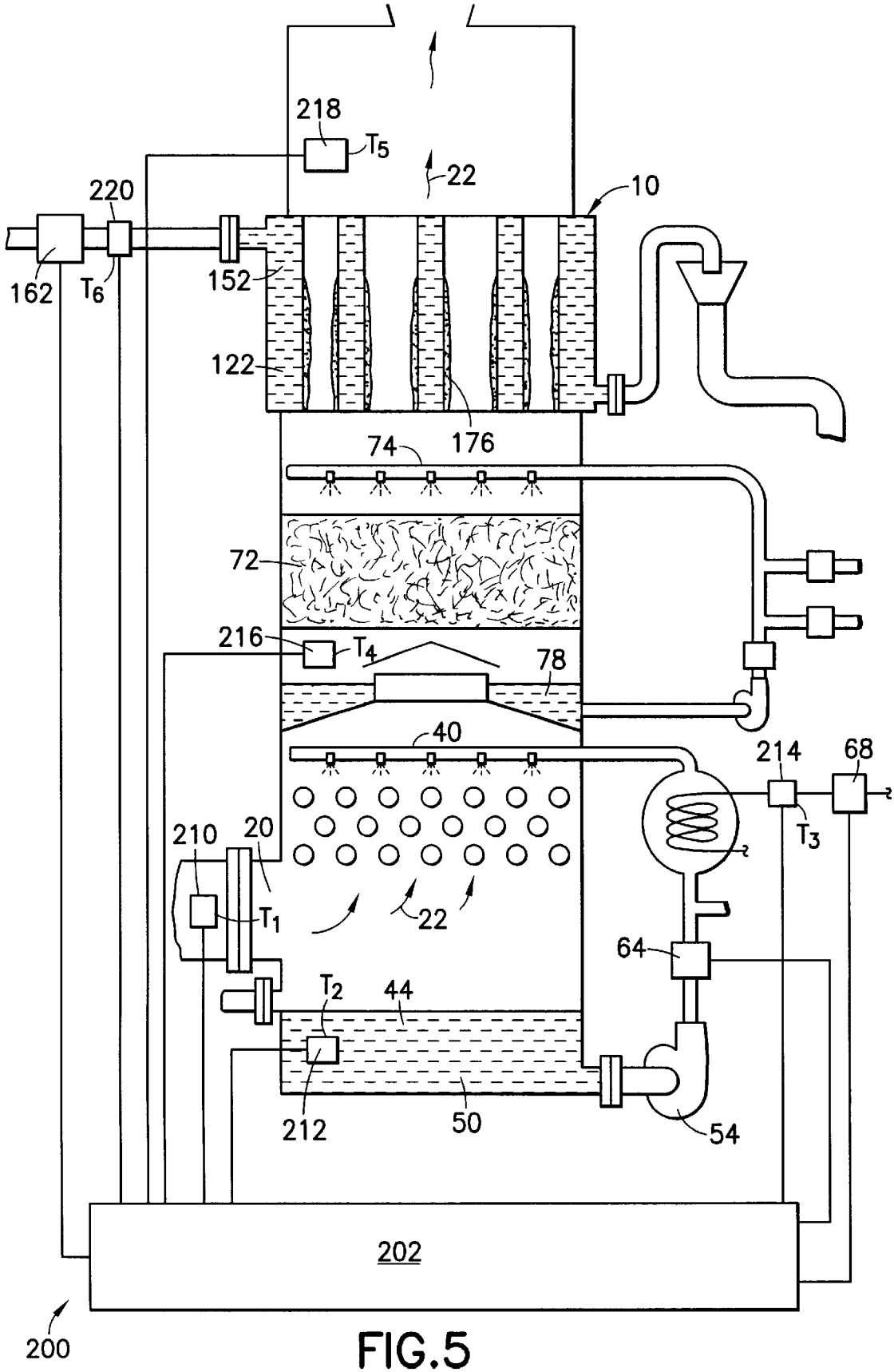
FIG. 5 is a schematic diagram of the control system of the apparatus.

Turning now to FIG. 5, as well as to FIG. 1, apparatus 10 includes a control system 200 which assures that the moisture and temperature conditions present in the gas stream 22, upon entry of the gas stream 22 into the condensing wet electrostatic precipitator 122, are conducive to the formation of condensate 176 for effective and efficient operation of the precipitator 122, independent of the temperature and moisture conditions present in the incoming gas stream 22 at port 20. Control system 200 includes a controller 202 which receives information from sensors in the control system 200 and activates control valves, based upon the received temperature information, to control the moisture and temperature conditions present in the gas stream 22 entering the precipitator 122. Thus, a temperature sensor 210 is located adjacent the port 20 for sensing the temperature $T_1$ of the incoming gas stream 22 and is connected to the controller 202 for transmitting the information to the controller 202. In a like manner, temperature information is transmitted to the controller 202 by the following temperature sensors connected to the controller 202: Temperature sensor 212 is located in the reservoir 50 to sense the temperature $T_2$ of the water 44 in the reservoir 50; temperature sensor 214 is located at the input 66 of the heat exchanger 65 to sense the temperature $T_3$ of the heat exchange medium entering the heat exchanger 65; temperature sensor 216 is located just beneath the bed 72 of the packed bed scrubber 70 and senses the temperature $T_4$ of the gas stream 22 as the gas stream 22 passes into the bed 72; temperature sensor 218 is located above the precipitator 122 to sense the temperature $T_5$ of the outgoing gas stream 22; and temperature sensor 220 is located at the water inlet 154 to sense the temperature $T_6$ of the cooling water 152 supplied to the water jacket 150. Based upon the temperature information received by the controller 202 from the temperature sensors 210, 212, 214, 216, 218 and 220, the controller 202 activates the control valves 64, 68 and 162 to maintain the temperature differential $T_4$ minus $T_5$ at a prescribed minimum, while the temperature differential $T_4$ minus $T_6$ is maintained at a prescribed, essentially constant level and the temperature $T_2$ is maintained at the full saturation temperature of the incoming gas stream. In the illustrated embodiment, $T_4$ minus $T_5$ is held to a minimum of about 3° F., $T_4$ minus $T_6$ is maintained at about 15° F., and the full saturation temperature $T_2$ usually is in the range of about 100° F. to 170° F. Thus, the heat exchanger 65 is utilized to control the temperature of the moisture supplied to the gas stream 22 by the spray header 40, while the temperature of the tubular walls 142 of the collector electrodes 140 is regulated by the water 152 in the water jacket 150, so that the gas stream 22 is provided with moisture and temperature conditions which assure the formation of sufficient condensate 176 at the electrode assemblies 124 of the condensing wet electrostatic precipitator 122.

The serial arrangement of the first stage scrubber, the second stage scrubber and the condensing wet electrostatic precipitator in vertical stacked alignment within apparatus 10 provides a complete apparatus and method for removing particulates and corrosive gases from an incoming gas stream in an integrated unit which is installed in a minimal space. The ability to remove larger particulates, that is, those having a diameter of about two microns and above, in a scrubber section and then to remove submicron particles, in a range down to about 0.01 micron, in an electrostatic precipitator renders apparatus 10 highly effective and economical for a wide variety of installations. The ability to remove corrosive gases from the gas stream prior to passing the gas stream into the condensing wet electrostatic precipitator allows the use of less expensive materials, such as relatively inexpensive steel alloys, rather than more expensive corrosion resistant alloys, for the component parts contacted by the gas stream 22, such as the tubular walls 142, without compromising the longevity of those component parts. The controlled conditions attained within the apparatus 10 assure that the condensing wet electrostatic precipitator of the apparatus operates effectively and efficiently, with minimal maintenance, over a long service life. The location of the packed bed scrubber 70 immediately beneath the condensing wet electrostatic precipitator 122, adjacent the inlet area 123, enables the bed 72 to distribute the gas stream 22 essentially evenly transversely across the inlet area 123, the bed 72 having a construction which distributes the flow of gas stream 22 across the transverse area of the bed 72.

It will be seen that the present invention attains the several objects and advantages summarized above, namely: Increases the efficiency and effectiveness of a condensing wet electrostatic precipitator for the removal of smaller particulates by providing controlled conditions for the formation of particle-capturing and flushing condensate; removes corrosive gases, as well as particulates, in a continuous process carried out in an integrated apparatus; enables more economical construction and operation of a condensing wet electrostatic precipitator by the removal of corrosive gases from a gas stream prior to entry of the gas stream into the condensing wet electrostatic precipitator, enabling the use of less expensive materials in the construction of the precipitator; provides a process and an integrated apparatus for the removal of larger particulates from an incoming gas stream so as to pass a gas stream containing essentially only smaller particulates to a condensing wet electrostatic precipitator, for increased effectiveness and efficiency; utilizes a heat exchange arrangement which increases the effectiveness and efficiency of heat transfer in cooling the condensing walls of a condensing wet electrostatic precipitator; reduces installation space requirements and cost; maintains cleaner electrodes during operation of a condensing wet electrostatic precipitator for maximizing effectiveness and efficiency; protects against deleterious deposits of particulates upon insulators which support the discharge electrodes of the electrostatic precipitator; provides an integrated apparatus and process for effective and reliable operation over a relatively long service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. Apparatus for removing particulates and corrosive gases from an incoming gas stream so as to deliver an outgoing gas stream free of the removed particulates and corrosive gases, the apparatus comprising:

an inlet for receiving the incoming gas stream and directing the incoming gas stream to a path of travel through the apparatus;

an outlet located along the path of travel extending vertically upwardly between the inlet and the outlet for delivering the outgoing gas stream;

a wet electrostatic precipitator section along the path of travel between the inlet and the outlet;

a scrubber section located vertically below the wet electrostatic precipitator along the path of travel between the inlet and the wet electrostatic precipitator section, the scrubber section being aligned vertically with the wet electrostatic precipitator section and including a moisture supplier for supplying moisture to the incoming gas stream; and a neutralizer for delivering a neutralizing agent into the path of travel between the scrubber section and the wet electrostatic precipitator section for contacting the incoming gas stream and neutralizing corrosive gases in the incoming gas stream;

whereby the incoming gas stream is moisturized with the moisture, and corrosive gases within the incoming gas stream are neutralized prior to entry of the incoming gas stream into the wet electrostatic precipitator section.

2. The apparatus of claim 1 wherein the scrubber section includes a packed bed scrubber, and the neutralizer delivers the neutralizing agent to the packed bed scrubber for distribution to the incoming gas stream as the incoming gas stream passes through the packed bed scrubber.

3. The apparatus of claim 2 wherein the wet electrostatic precipitator section includes an inlet area, and the packed bed scrubber is located adjacent the inlet area along the path of travel for assisting in distributing the incoming gas stream over the inlet area of the wet electrostatic precipitator section.

4. The apparatus of claim 1 wherein the wet electrostatic precipitator section includes discharge electrodes for carrying an electrostatic charge of a given polarity, and the scrubber section includes further electrodes for imparting to the moisture in the incoming gas stream an electrostatic charge having a polarity opposite to the given polarity.

5. The apparatus of claim 4 wherein at least some of the discharge electrodes each include an ionizing section, and an attraction section for attracting the moisture charged by the further electrodes.

6. The apparatus of claim 5 wherein the scrubber section includes a packed bed scrubber having a packed bed, and the further electrodes extend into the packed bed.

7. The apparatus of claim 1 wherein the wet electrostatic precipitator section includes collection electrodes having condensing walls upon which moisture supplied to the incoming gas stream is condensed such that condensate formed on the condensing walls entrains particulates, the scrubber section includes a liquid distribution scrubber, and the moisture supplier includes a liquid distributor for distributing liquid into the incoming gas stream, the moisture supplier further including a temperature controller for controlling the temperature of the liquid distributed by the liquid distributor so as to assure the formation of condensate on the condensing walls of the collection electrodes.

8. The apparatus of claim 7 wherein the liquid distribution scrubber includes a plurality of bars extending transverse to the path of travel and located between the inlet and the liquid distributor.

9. The apparatus of claim 7 wherein the wet electrostatic precipitator section includes a coolant jacket for circulating coolant to the condensing walls, the coolant jacket having a coolant inlet and a coolant outlet, the coolant inlet being located vertically above the coolant outlet so as to assist circulation of cooler incoming coolant at the coolant inlet toward warmer outgoing coolant at the coolant outlet.

10. The apparatus of claim 7 wherein the wet electrostatic precipitator section includes discharge electrodes for carrying an electrostatic charge of given polarity, and the apparatus includes further electrodes located vertically below the wet electrostatic precipitator for imparting to moisture in the incoming gas stream an electrostatic charge having a polarity opposite to the given polarity.

11. The apparatus of claim 10 wherein the discharge electrodes each include an ionizing section, and an attraction section for attracting the moisture charged by the further electrodes.

12. In an apparatus for removing particulates from an incoming gas stream so as to deliver an outgoing gas stream free of the removed particulates, an improvement comprising:

an inlet for receiving the incoming gas stream and directing the incoming gas stream to a path of travel through the apparatus;

an outlet located along the path of travel for delivering the outgoing gas stream;

a wet electrostatic precipitator section along the path of travel between the inlet and the outlet; and a moisture supplier for supplying moisture to the incoming gas stream, the moisture supplier including a liquid distributor for distributing liquid into the incoming gas stream;

the wet electrostatic precipitator section including collection electrodes having condensing walls upon which moisture supplied to the incoming gas stream is condensed such that condensate formed on the condensing walls entrains particulates;

the moisture supplier further including a temperature controller for controlling the temperature of the liquid distributed by the liquid distributor so as to assure the formation of condensate on the condensing walls of the collection electrodes.

13. The improvement of claim 12 wherein the wet electrostatic precipitator section includes discharge electrodes for carrying an electrostatic charge of given polarity, and the apparatus includes further electrodes located adjacent the wet electrostatic precipitator for imparting to moisture in the incoming gas stream an electrostatic charge having a polarity opposite to the given polarity.

14. The improvement of claim 13 wherein the discharge electrodes each include an ionizing section, and an attraction section for attracting the moisture charged by the further electrodes.

15. The improvement of claim 12 wherein the path of travel extends vertically upwardly between the inlet and the outlet, and the wet electrostatic precipitator section includes a coolant jacket for circulating coolant to the condensing walls, the coolant jacket having a coolant inlet and a coolant outlet, the coolant inlet being located vertically above the coolant outlet so as to assist circulation of cooler incoming coolant at the coolant inlet toward warmer outgoing coolant at the coolant outlet.

16. The improvement of claim 12 wherein the wet electrostatic precipitator includes a plurality of discharge electrodes supported within the gas stream by a support assembly including insulator members adjacent the gas stream, the improvement further comprising:

discharge electrode elements in the support assembly, located between the gas stream and the insulator members; and collector electrode elements juxtaposed with the discharge electrode elements so as to establish an electrostatic field between each discharge electrode element and a corresponding collector electrode element for collecting particulates in the gas stream on each collector electrode element to preclude deposit of the collected particulates on the insulator members.

17. The improvement of claim 16 wherein the support assembly includes:

a bus frame, the discharge electrodes being mounted upon the bus frame; and support members extending between the bus frame and the insulator members, the discharge electrode elements being located on the support members.

18. The improvement of claim 17 wherein the gas stream flows generally vertically upwardly, the discharge electrodes are suspended downwardly from the bus frame, and the bus frame is suspended by the support members below the insulator members, the discharge electrode elements being located vertically between the insulator members and the bus frame.

19. A method for removing particulates and corrosive gases from an incoming gas stream so as to deliver an outgoing gas stream free of the removed particulates and corrosive gases, the method comprising:

receiving the incoming gas stream and directing the incoming gas stream along a path of travel toward a wet electrostatic precipitator section;

scrubbing the incoming gas stream along the path of travel to remove larger particulates prior to passing the incoming gas stream to the wet electrostatic precipitator section;

supplying moisture to the incoming gas stream prior to passing the incoming gas stream to the wet electrostatic precipitator section;

neutralizing corrosive gases in the incoming gas stream prior to passing the incoming gas stream to the wet electrostatic precipitator section;

whereby the incoming gas stream is moisturized with the moisture, and corrosive gases within the incoming gas stream are neutralized prior to entry of the incoming gas stream into the wet electrostatic precipitator section;

removing smaller particulates from the incoming gas stream by condensing moisture supplied to the incoming gas stream within the wet electrostatic precipitator section; and delivering the outgoing gas stream at an outlet subsequent to passing the incoming gas stream to the wet electrostatic precipitator section.

20. The method of claim 19 including controlling the temperature of the moisture supplied to the incoming gas stream so as to assure condensation of the moisture in the electrostatic precipitator section and consequent entrainment of the smaller particulates.

21. In a method for removing particulates from an incoming gas stream so as to deliver an outgoing gas stream free of the removed particulates, the improvement comprising:

receiving the incoming gas stream and directing the incoming gas stream along a path of travel toward a wet electrostatic precipitator section;

supplying moisture to the incoming gas stream prior to passing the incoming gas stream to the wet electrostatic precipitator section, whereby the incoming gas stream is moisturized with the moisture prior to entry of the incoming gas stream into the wet electrostatic precipitator section;

removing particulates from the incoming gas stream by condensing moisture supplied to the incoming gas stream within the wet electrostatic precipitator section;

controlling the temperature of the moisture supplied to the incoming gas stream so as to assure condensation of the moisture in the electrostatic precipitator section and consequent entrainment of the particulates; and delivering the outgoing gas stream at an outlet subsequent to passing the incoming gas stream to the wet electrostatic precipitator section.

22. The method of claim 21 wherein the wet electrostatic precipitator section includes discharge electrodes for carrying an electrostatic charge of a given polarity, the discharge electrodes having an ionizing section and an attraction section, and collection electrodes having condensing walls upon which moisture supplied to the incoming gas stream is condensed such that condensate formed on the condensing walls entrains particulates, the method including charging some of the moisture in the incoming gas stream with an electrostatic charge having a polarity opposite to the given polarity for attracting the moisture charged with the electrostatic charge having the polarity opposite to the given polarity to the attraction section of the discharge electrodes.

* * * * *